US007055623B2

(12) United States Patent
Calderoni et al.

(10) Patent No.: US 7,055,623 B2
(45) Date of Patent: Jun. 6, 2006

(54) METHOD FOR THE DRILLING OF THE INITIAL PHASE OF DEEP WATER OIL WELLS WITH AN UNDERWATER WELL HEAD

(75) Inventors: Angelo Calderoni, San Donato Milanese-Milan (IT); Claudio Maria Molaschi, Crema-Cremona (IT); Guido Brusco, San Donato Milanese-Milan (IT)

(73) Assignee: ENI S.p.A., Rome (IT)

( * ) Notice: Subject to any disclaimer, the term of this patent is extended or adjusted under 35 U.S.C. 154(b) by 0 days.

(21) Appl. No.: 10/433,415

(22) PCT Filed: Nov. 12, 2001

(86) PCT No.: PCT/EP01/13171

§ 371 (c)(1),
(2), (4) Date: Nov. 17, 2003

(87) PCT Pub. No.: WO02/46570

PCT Pub. Date: Jun. 13, 2002

(65) Prior Publication Data

US 2004/0060736 A1 Apr. 1, 2004

(30) Foreign Application Priority Data

Dec. 6, 2000 (IT) ..... MI2000A2641

(51) Int. Cl.
*E21B 7/12* (2006.01)
*E21B 29/12* (2006.01)

(52) U.S. Cl. ..... 175/6; 175/5; 166/358

(58) Field of Classification Search ..... 166/350, 166/358, 368, 71; 175/5–7, 171
See application file for complete search history.

(56) References Cited

U.S. PATENT DOCUMENTS

| | | | | |
|---|---|---|---|---|
| 3,163,238 | A | 12/1964 | Malott | |
| 3,186,499 | A | 6/1965 | Bullard | |
| 3,519,071 | A | 7/1970 | Word | |
| 3,621,910 | A * | 11/1971 | Sanford et al. | 166/335 |
| 3,653,435 | A * | 4/1972 | Reistle et al. | 166/366 |
| 3,682,243 | A * | 8/1972 | Bauer et al. | 166/338 |
| 3,703,212 | A * | 11/1972 | Abrahams | 175/173 |
| 3,732,143 | A * | 5/1973 | Joosse | 175/6 |
| 4,133,396 | A * | 1/1979 | Tschirky | 175/57 |
| 4,759,413 | A * | 7/1988 | Bailey et al. | 175/6 |
| 5,184,686 | A * | 2/1993 | Gonzalez | 175/5 |
| 6,102,119 | A * | 8/2000 | Raines | 166/244.1 |
| 6,138,774 | A * | 10/2000 | Bourgoyne et al. | 175/7 |
| 6,296,066 | B1 * | 10/2001 | Terry et al. | 175/92 |
| 6,412,574 | B1 * | 7/2002 | Wardley et al. | 175/7 |
| 6,745,853 | B1 * | 6/2004 | Turner et al. | 175/5 |
| 2003/0152428 | A1 * | 8/2003 | Wentworth et al. | 405/184.2 |

* cited by examiner

*Primary Examiner*—Thomas A Beach
(74) *Attorney, Agent, or Firm*—Oblon, Spivak, McClelland, Maier & Neustadt, P.C.

(57) ABSTRACT

Improved method for the drilling of the initial phase of deep water oil wells with an underwater well head consisting in the positioning and cementation of the conductor pipe and anchorage casing by means of a single drilling phase. A tapered hole (with a double diameter) is drilled using a drill string consisting of a motor driven pilot bit and a reaming bit.

3 Claims, 7 Drawing Sheets

METHOD FOR THE DRILLING OF THE INITIAL PHASE OF DEEP WATER OIL WELLS WITH AN UNDERWATER WELL HEAD

The present invention relates to an improved method for the drilling of the initial phase of deep water oil wells with an underwater well head which allows the simultaneous positioning and cementation of the conductor pipe and anchorage casing in a single drilling phase.

During the drilling of oil wells, set casing operations of the hole are effected, which comprise the positioning of specific casings at pre-established intervals in relation to the depth reached and characteristics of the formations penetrated.

The set casing and lowering of the casings into the well generally follow the drilling of a hole section having a suitable diameter.

During the drilling, with the conventional technology, of the initial phase of deep water oil wells with an underwater well head, a 42" or 36" hole is produced for positioning the 36" or 30" conductor pipe, and subsequently, after cementing this casing, a new 26" or 17"½ hole is effected for positioning a 20" anchorage casing or mixed 20"–13"⅜ casing.

The necessity of carrying out two separate drilling phases lies in the difficulty of producing, in a single phase, a tapered hole (with a double diameter) having the qualitative characteristics required for the positioning of the casing. The requisites of the hole are substantially:

Perfect verticality

Constant diameter for each interval (avoiding caved holes)

The inability to reach any one of these two requisites can lead to the necessity of drilling a new hole. If a certain inclination of the hole is exceeded, in fact, it is impossible to position the underwater production cross on the well head, whereas a particularly caved hole jeopardizes the cementation of the casing and consequently failure to reach the mechanical resistance values of the whole structure.

SUMMARY OF THE INVENTION

One non-limiting embodiment of the present invention provides an improved method for the drilling of the initial phase of deep water oil wells with an underwater well head. The method includes positioning and cementing the conductor pipe and anchorage casing in a single drilling phase, wherein the drilling is effected by a drill string including a chisel bit. reaming bit and a motor configured to drive the chisel bit independently of the reaming bit. In one embodiment, the drilling includes a first phase during which only the chisel bit rotates and a second phase during which the whole drill string rotates.

DETAILED DESCRIPTION

Figure 1:
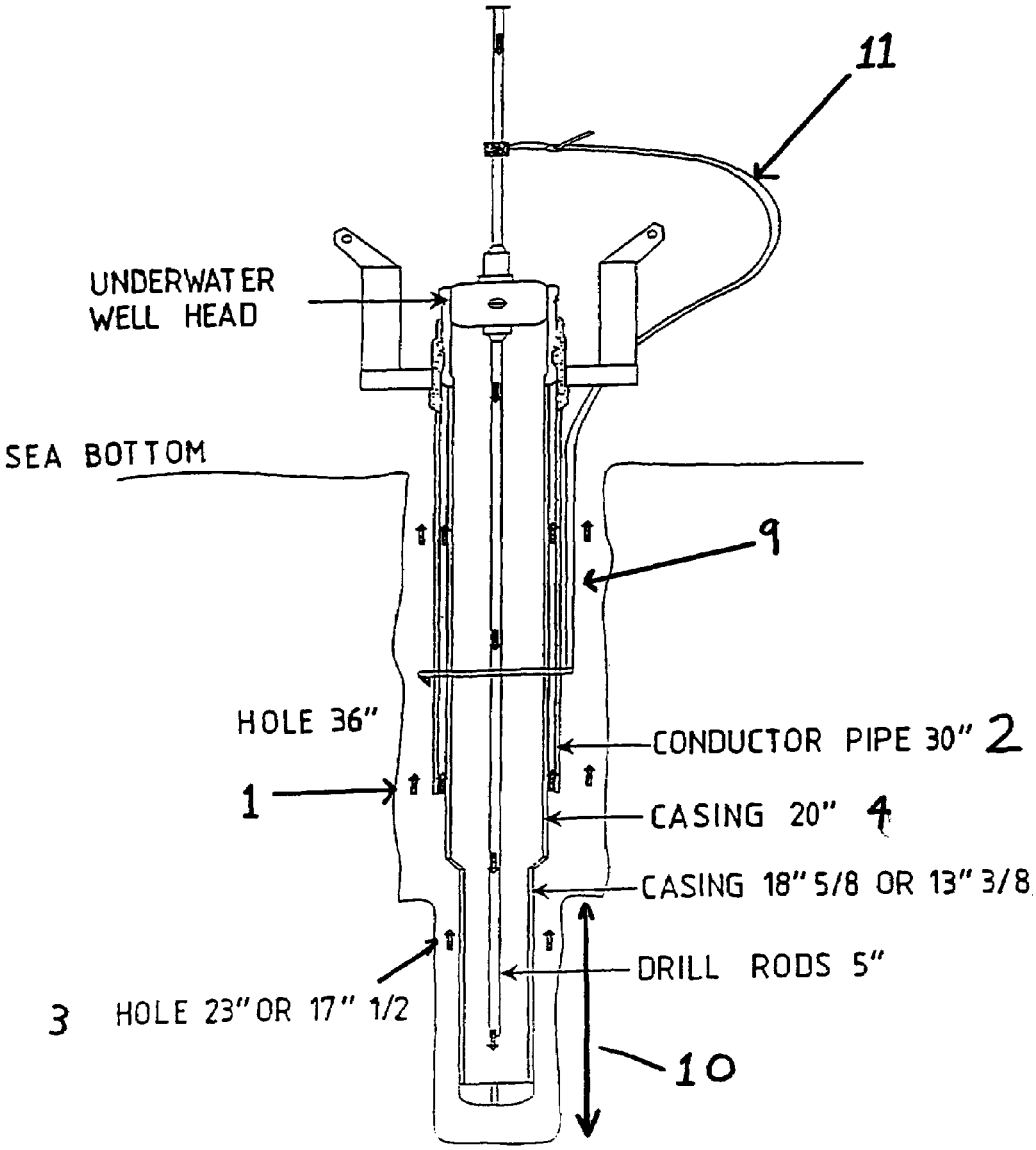
FIG. 1 shows a cross-section view of an underwater well head embedded in a sea bottom in a hole having two different inside diameters.

The drilling method according to the present invention allows the drilling, in a single sequence, of a tapered hole (with a double diameter). The tapered hole is 36" in diameter to a certain depth (driving depth of the 30" conductor pipe 2) and 23" or 17"½ in diameter to the depth required for the 20" anchorage casing 4 or mixed 20"–13"⅜ casing. The drill string 7 therefore consists of a 23" (or 17"½) chisel bit 5 and a 36" reaming bit 6 suitably spaced so as to effect hole sections of the desired depth.

The drilling sequence is divided into two distinct phases: the first is effected by not rotating the drill string 7 and guaranteeing the rotation of the 23" or 17"½ chisel bit 5 by means of a lower motor 8 which is also equipped so as to automatically control the verticality of the hole, the second by rotating the drill string 7 as to allow the 3641 reaming bit 6 to act on the formation. The hole thus obtained has the necessary verticality and constant diameter required for positioning the casings in an underwater environment. The conductor pipe 2 and anchorage casing 4 are then simultaneously positioned and cemented in a single operation.

This positively influences the times necessary for the formation of the holes, and the positioning and cementation of the casings, with a consequent cost reduction.

For the automatic control of the well verticality, the use of a device called "Straight Hole Drilling Device (SDD)" , a drilling instrument produced by the Applicant in collaboration with Baker Hughes, has proved to be particularly advantageous. This device, contrary to the conventional systems, automatically effects a continuous verticality correction, based on a feedback control which guarantees the absolute verticality of the holes.

Various automatic verticality control equipment is becoming available on the market, such as:

RDS of Camco;

AGS of Cambridge Automation

Well Director of Well Done

These can be valid alternatives to be used instead of the Baker Hughes (SDD) device.

As an illustrative and non-limiting example of the method according to the present invention, the set casing and cementation procedure is effected as follows.

After producing a perfectly vertical and well calibrated hole, the simultaneous lowering of the casings into the well and their cementation, can be effected. In order to ensure a correct cementation of the casings so as to allow the whole structure to have the desired mechanical resistance characteristics, the following precautions should be noted:

To have an alternative cementation system, should the main cementation by means of the internal drill string not reveal the return of sea-bottom mortar from the large annulus 9 consisting of the 36" hole 1 and 30" conductor pipe and from small annulus 10 between the 20" anchorage casing 4 or mixed 20"–13"⅜ casing and the inside of the 30" conductor pipe (see FIG 1).

Figure 2:
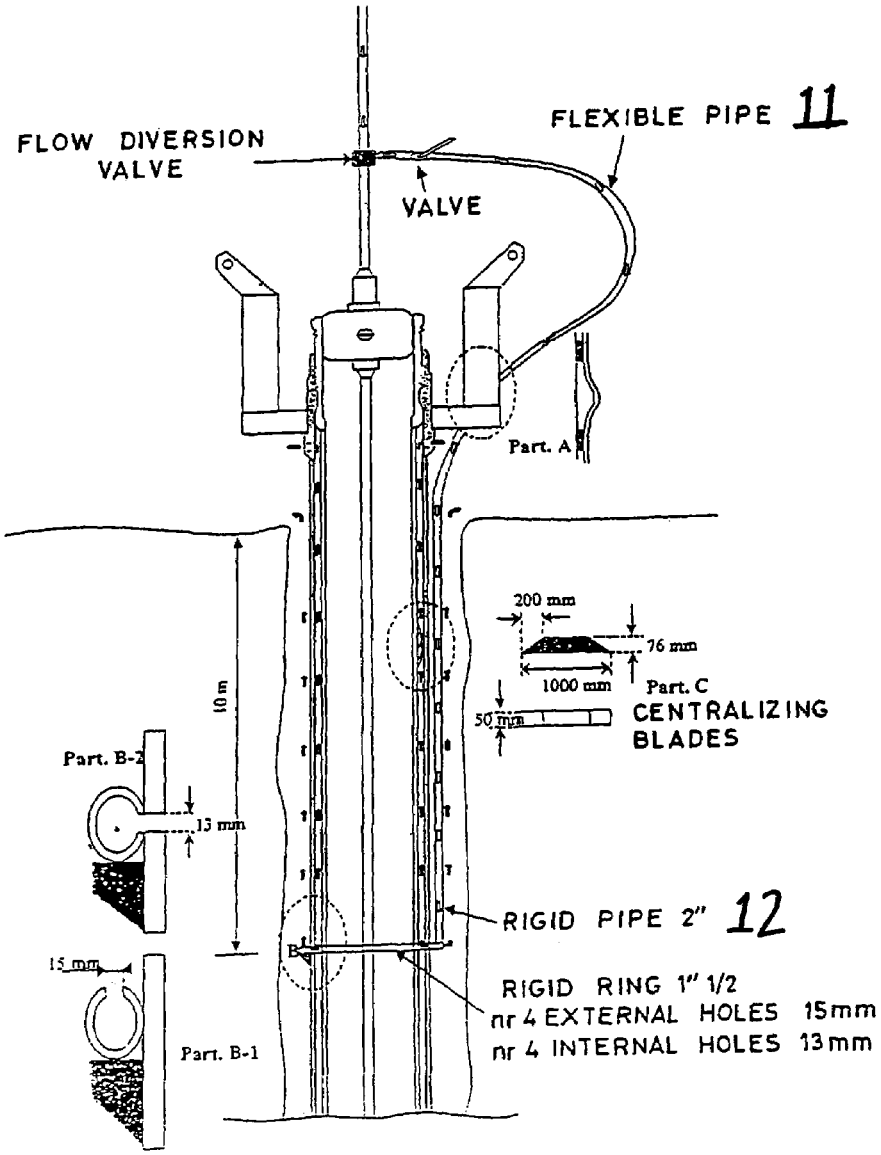
FIG. 2 shows an underwater well head with a flexible pipe for mortar and also a rigid pipe for passing mortar.
Figure 3:
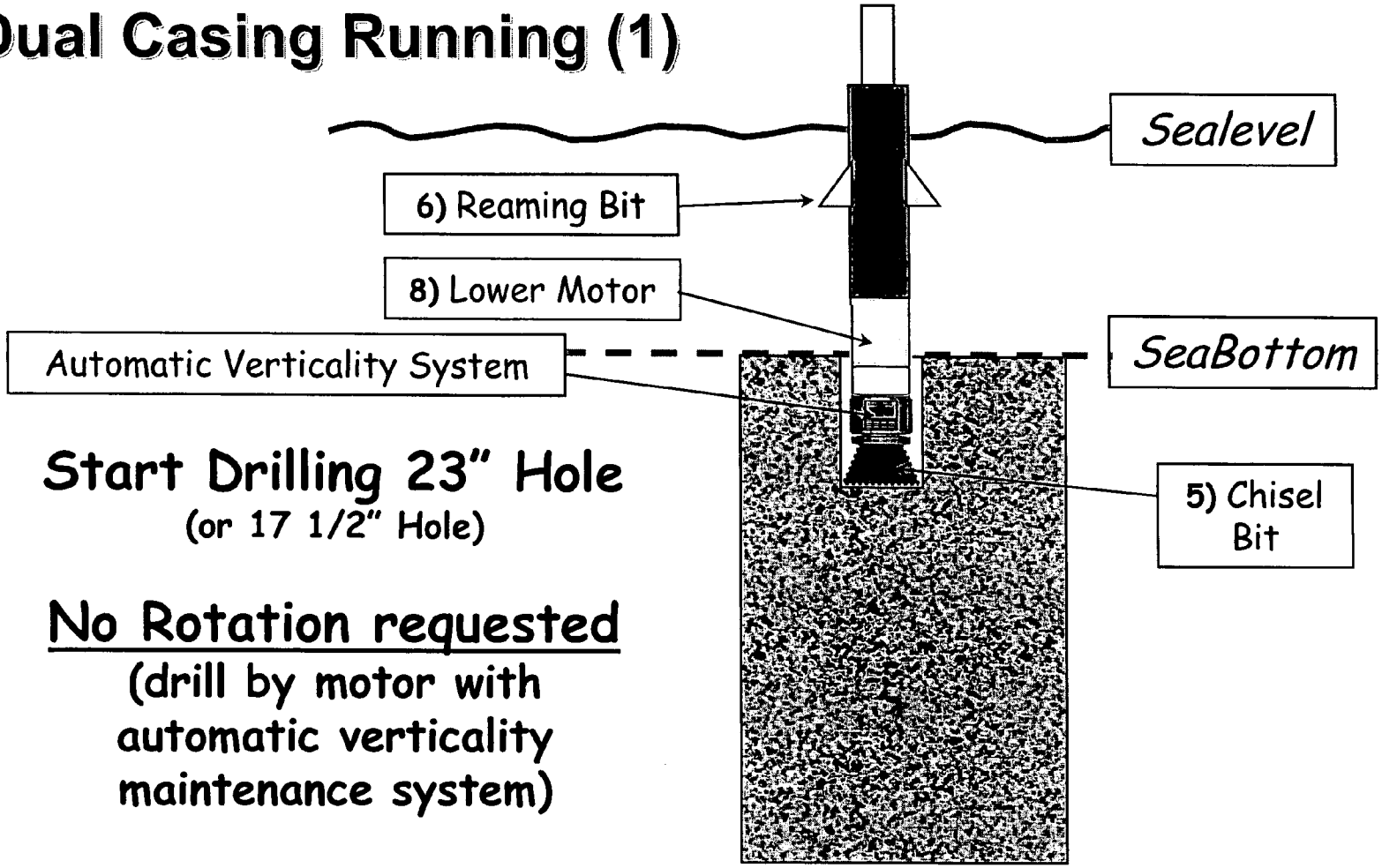
FIG. 3 shows a dual casing drill with a reaming bit and a chisel bit wherein the reaming bit is not in contact with the sea floor, but the chisel bit has penetrated the sea floor.
Figure 4:
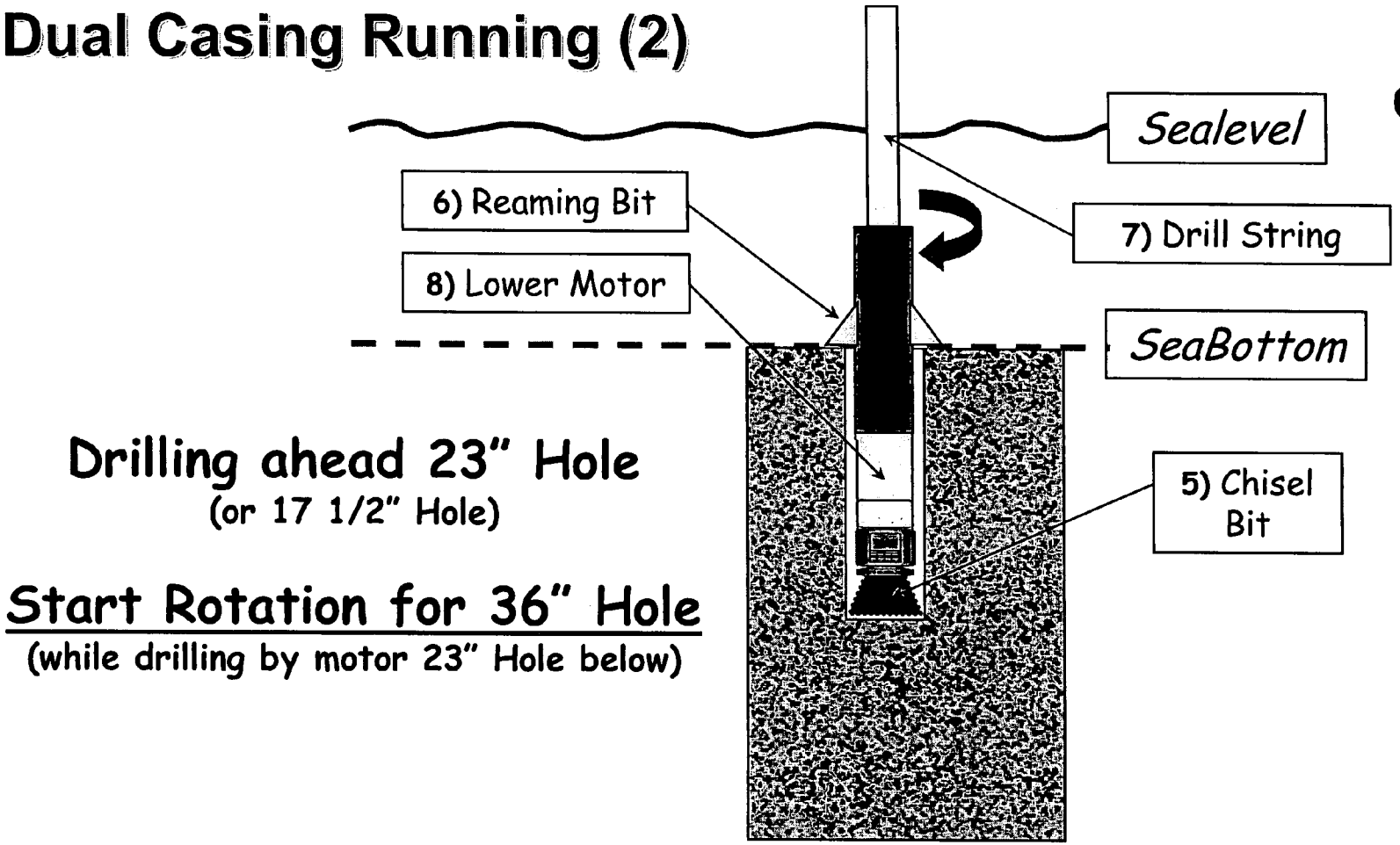
FIG. 4 shows the drill with the chisel bit penetrated into the sea floor and the reaming bit in contact with the sea floor.
Figure 5:
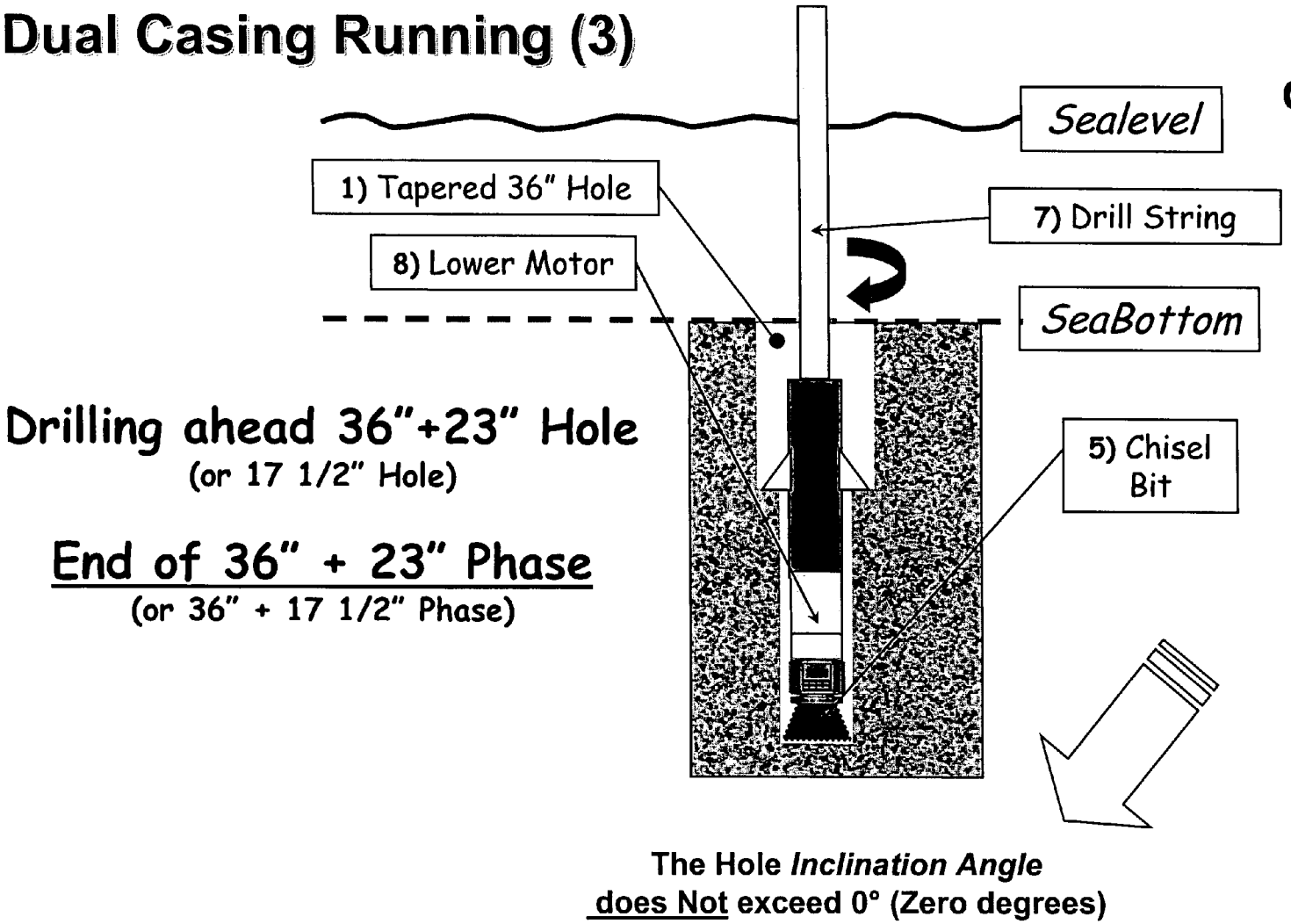
FIG. 5 shows the drill with both the chisel bit and the reaming bit after penetration into the sea floor.
Figure 6:
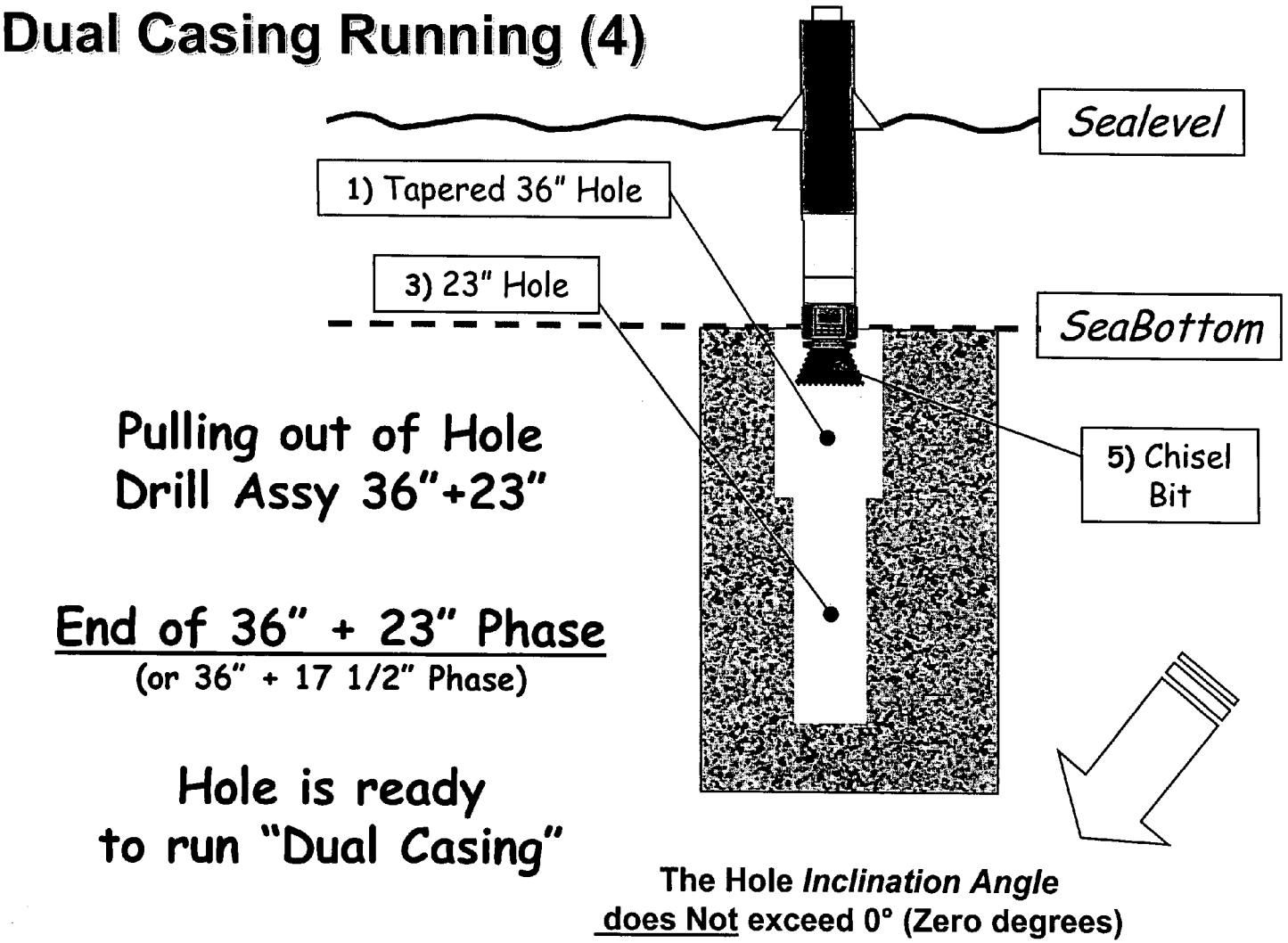
FIG. 6 shows the drill being retracted after a hole with two separate diameters has been drilled with the chisel bit and the reaming bit.
Figure 7:
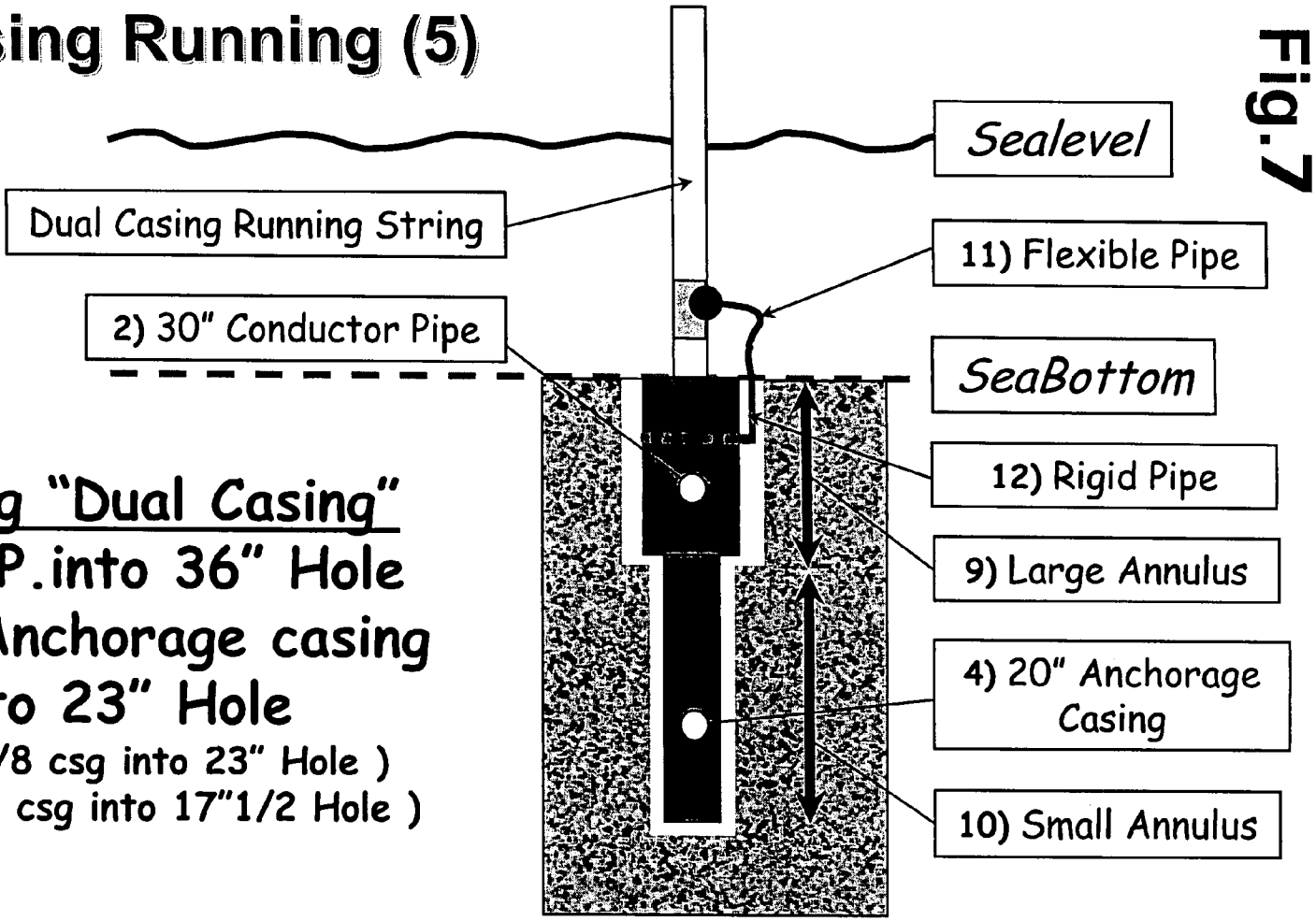
FIG. 7 shows a 30-inch conductor pipe and a 20-inch diameter anchorage casing inserted into the hole formed by the apparatus in FIG. 6.

In this case a sphere is launched inside the drill rods, which is housed in a device situated in the drill string itself and, by means of pressurization, allows the mortar to pass through a flexible pipe 11 and then through a rigid pipe 12 until it reaches rigid ring 13, pre-deformed so as to encircle the conductor pipe 2, positioned about 10 m from the sea bottom (see FIG 2). The latter element is previously perforated to allow access to the two annulars 9 and 10. For example, the rigid ring may have 4 external holes of 15 mm diameter and 4 internal holes of 13 mm diameter. At the end of this operation, the flexible pipe 11 is cut using a device assembled on the arm of an automatic vehicle controlled from the surface, to allow the flushing of the drill string, which would otherwise remain full of cement mortar.

The invention claimed is:

1. An improved method for the drilling of the initial phase of deep water oil wells with an underwater well head comprising:

positioning and cementing the conductor pipe and anchorage casing in a single drilling phase, wherein the drilling is performed with a drill string including a chisel bit, reaming bit and a motor configured to drive the chisel bit independently of the reaming bit.

2. The improved method for the drilling of the initial phase of deep water oil wells according to claim 1, wherein the drilling comprises:

a first phase during which only the chisel bit rotates; and a second phase during which the whole drill string rotates.

3. The improved method for the drilling of the initial phase of deep water oil wells according to claim 1, wherein the motor is configured to automatically control the verticality of the hole.

* * * * *